US007971842B2

(12) United States Patent
Burrous et al.

(10) Patent No.: US 7,971,842 B2
(45) Date of Patent: Jul. 5, 2011

(54) SWIVELABLE SIGN HANGING ARRANGEMENT

(75) Inventors: Thomas P. Burrous, Haverhill, MA (US); David E. Pitcher, Swampscott, MA (US); Rebecca C. Suciu, Lynn, MA (US); Alan L. Stenfors, Scituate, MA (US); Sidney Rose, Marblehead, MA (US)

(73) Assignee: Rose Displays, Ltd., Salem, MA (US)

( * ) Notice: Subject to any disclaimer, the term of this patent is extended or adjusted under 35 U.S.C. 154(b) by 483 days.

(21) Appl. No.: 12/215,311

(22) Filed: Jun. 26, 2008

(65) Prior Publication Data

US 2009/0320339 A1 Dec. 31, 2009

(51) Int. Cl.
*A47H 1/10* (2006.01)

(52) U.S. Cl. ..... 248/317; 40/617; 248/324

(58) Field of Classification Search ..... 248/317, 248/318, 320, 324, 343; 40/601, 617
See application file for complete search history.

(56) References Cited

U.S. PATENT DOCUMENTS

| | | | | |
|---|---|---|---|---|
| 5,381,991 | A * | 1/1995 | Stocker | 248/206.5 |
| 5,480,116 | A * | 1/1996 | Callas | 248/228.4 |
| 5,870,845 | A * | 2/1999 | Ruderman et al. | 40/601 |
| 2004/0031898 | A1 * | 2/2004 | Mijatovic | 248/330.1 |
| 2006/0243876 | A1 * | 11/2006 | Arakawa | 248/317 |

* cited by examiner

*Primary Examiner* — Ramon O Ramirez
(74) *Attorney, Agent, or Firm* — Don Halgren

(57) ABSTRACT

A swivelable support assembly for angularly adjustably supporting a sign from an overhead support rail. The support assembly comprises an elongated upper wing attachable to the overhead rail. An elongated lower wing is swivelably attached to the upper wing, the sign being secured to the lower wing. The lower wing has a housing with an alignment port therein for facilitating entry of a lift pole therein.

14 Claims, 6 Drawing Sheets

SWIVELABLE SIGN HANGING ARRANGEMENT

BACKGROUND OF THE INVENTION

1. Field of the Invention

This invention relates to sign hanging mechanisms which are attachable to ceiling rails typically found in commercial stores, and more particularly to an adaptable swivel support which is easily attachable and removable from such overhead ceiling rails.

2. Prior Art

The changing of advertising signs in commercial establishments is an ongoing exercise done many times every day. Often a store clerk must use a tall ladder to try to hang and manipulate an advertising sign from an overhead support, which support is usually an inverted "T" shaped ceiling rail. Such sign changing exercises are cumbersome at best and may be difficult and dangerous at the worst.

There are prior art sign support arrangements which are lifted into and out of magnetic contact with the overhead ceiling rails by gripping "jaws' which are manipulated by a pull cord to engage and disengage the jaws from the sign holder. Such a device requires one hand to manipulate the pole and one hand to manipulate the pull cord. This is a time consuming and difficult way of setting up and changing an overhead store sign display.

There is a thus need for a store sign technique/apparatus which permits a sign to be hung expeditiously and uneventfully from an overhead support such as the inverted "T" shaped ceiling support rail. Such ceiling rails however, may not always line up with the direction in which a sign is desired to be displayed. Other types of devices also exist all of which require difficult or non-intuitive motions during use.

It is therefore an object of the present invention to overcome the disadvantages of the prior art.

It is yet a further object of the present invention to provide a sign holding support arrangement which is readily attachable and removable from an overhead ceiling support rail.

It is yet a further object of the present invention to provide a sign holding arrangement which is readily changeable from which the direction in which a sign is suspended.

It is yet still a further object of the present invention to provide a sign support arrangement which is readily removable by the same tool by which it is placed against a ceiling support rail.

It is also an object of the present invention to provide a sign support arrangement which may be installed and removed relative to an overhead ceiling rail, which permits self-alignment between the lift pole and the sign holder when placing the sign holder and removing it from the overhead site.

It is still yet a further object of the present invention, to provide such a support arrangement which is very easily attached and removed from such overhead support rail in a very simple and cost effective manner.

BRIEF SUMMARY OF THE INVENTION

The present invention comprises a multi-component swivel assembly for attaching an advertisement or sign in a manipulable manner to an overhead inverted "T"-shaped ceiling rail. The swivel assembly is attached to the overhead ceiling rail by a set of spaced apart magnets which are disposed on the upwardly directed side of an upper swivel wing which is a component of the multi-component swivel assembly. The advertising sign is supported from a lower swivel wing which is in swiveling engagement with the upper swivel wing thereattached. The multi-component swivel assembly is raised to the inverted "T"-shaped ceiling rail by an elongated lift pole having a distal lift pole engagement end. The lower swivel wing has a set of support lines extending from an end of each lower swivel wing, and attached to an advertisement sign therebeneath. The multi-component swivel assembly comprises a lower swivel wing having an elongated first lower arm and a second lower arm extending diametrically opposed to one another from opposite sides of a generally cylindrically shaped lower swivel housing.

The lower swivel housing has a shouldered annular support surface extending generally circumferentially therearound. An inner annular flange extends upwardly from the shouldered angular support surface and is arranged to receive an annular upper swivel housing of the upper swivel wing. The upper swivel wing comprises a first upper arm and a second upper arm diametrically opposed about the upper swivel housing. A magnet is lockably disposed at each distalmost end of each of the upper first and the second arms of the upper swivel housing. The upper first arm and the upper second arm each have the magnet extending upwardly from their distalmost ends. The upper first arm and the upper second arm each have an elongated magnet locking plate slidably disposed therein. Each elongated magnet locking plate is radially displaceable so as to permit attachment and/or removal of a magnet at the distalmost ends of the respective arms. Each elongated magnet locking plate has a radially inwardly directed or proximal end with a stepped cap-engaging lip arranged thereon. Each stepped cap-engaging lip has an arcuate innermost edge. The upper swivel housing and its respective first and second upper arms are arranged to rotatively mate with the annular shouldered support surface of the lower swivel housing.

A circular, planar swivel cap is attachable to the upper side of the upper swivel housing and has a peripheral edge which is in slidable engagement with the arcuate inner surfaces of the stepped capped engaging lip on each respective elongated magnet locking plate. The swivel cap is secured to an arrangement of threaded connector receiving openings molded within the inside contours and parallel to the longitudinal axis of the rotatable lower swivel housing. The swivel cap has a plurality of openings for receipt of the upper end of the threaded connectors to be disposed between the swivel cap and the lower swivel housing. The threaded connection of the swivel cap to the lower swivel housing with the upper swivel housing sandwiched therebetween holds the assembly together.

The upper swivel wing is arranged so as to permit rotation between the upper swivel wing and the lower swivel wing once the magnets are attached to the lower side of an inverted "T"-shaped ceiling rail.

The multi-component swivel assembly is attached, as aforementioned, to the ceiling rail by a lift pole. The lift pole has an upper distalmost "engagement end". The lift pole engagement end has an end with a pointed distalmost end, with tapered shoulders thereon, and also having a body portion which is comprised of a generally flat, distal, lower wing engagement flange. The distal engagement flange has a front face with a generally chevron shaped engagement-flange locking-channel recessed thereacross. The distal, lower wing engagement flange has a generally planar or flat rear face thereon. The front face and the rear face of the engagement end of the lift pole proximately have a pair of pole shoulders arranged thereon. The lower swivel housing has a pair of matching lower housing shoulders which correspond in slope, to the pair of pole shoulders proximally adjacent the engagement flange. The sloped shoulders permit a self-alignment and entry of the distalmost end of the pointed engagement end of the lift pole into an elongated flange receiving slot extending diametrically across the lower swivel housing which is arranged so as to receive the distalmost engagement flange of the lift pole. A pair of corresponding chevron-shaped inwardly directed, engagement flange housing-receiving lips are arranged on each side of the elongated flange receiving slot.

When it is desired to attach the magnets which are arranged on the upper side of the upper swivel wing to an overhead ceiling rail, after the distalmost end of the engagement end is self-aligned through the angled shoulders adjacent the receiving slot, the distal engagement flange of the lift pole is then further inserted through the elongated flange receiving slot in the housing of the lower wing, and the magnets are directed and lifted towards magnetic attachment to the inverted "T"-shaped ceiling rail. That same lift pole, with its transverse distal engagement flange thereon, may be utilized to swivel the lower swivel wing with respect to the upper swivel wing by torqued rotation of the lift pole. A support line would be extending from each end of the lower swivel wing, to corresponding respective ends of a sign to be supported therefrom.

When it is desired to remove a sign and change it from attachment from an overhead rail, the lift pole with its distal engagement flange is then self-alignably re-inserted into the tapered area of the lower swivel and into the elongated-flange receiving slot, and brought down slightly, so that the engagement flange locking channel, of chevron shape, mates with one or the other of the engagement flange housing receiving lips on one of the sides of the elongated receiving slot in the housing in the lower wing. A mere pulling down of the elongated lift pole will break the magnetic attachment between the magnets and the overhead ceiling rail, to permit the entire multi-component swivel assembly to be removed therefrom and a new sign or advertisement thereattached or for subsequent reattachment to that ceiling rail.

The invention thus comprises an angularly adjustable, swivelable support assembly for adjustably supporting a sign from an overhead support rail, comprising: an elongated upper wing attachable to the overhead rail; an elongated lower wing swivelably attached to the upper wing, the sign being secured to the lower wing. The lower wing has an alignment port to facilitate engagement and lockable receipt of the tip of the lift pole therein. The upper wing comprises a first upper arm and a second upper arm arranged diametrically about an upper swivel housing. The lower wing comprises a first lower arm and a second lower arm arranged diametrically about a lower swivel housing. The lower housing is rotatable with respect to the upper housing. The first upper arm and the second upper arm have a magnet secured to a distal end thereof. The magnet is preferably lockable in position by a slidable elongated plate movable to and from the distal end of the first upper arm and the second upper arm. The lower swivel housing has a receiving opening for receipt of a lift pole. The lower swivel housing is rotatable about its longitudinal axis by rotation of a lift pole installed therewith, with respect to the upper swivel housing. The sign is securable to the lower wing by a support line extending from an end of the wing.

The invention also includes a method of angularly adjustably supporting a sign from an overhead ceiling support rail comprising one or more of the following steps of: lifting a multi-component support assembly into attachment with the overhead ceiling support rail by a lift pole, the support assembly having a sign attached thereto; rotating a second component of support assembly with respect to a first component of the support assembly to permit the sign to line up with any desired horizontally angular orientation; inserting the lift pole into the second component of the multi-component support assembly; engaging a channel on the lift pole into fitting engagement with a lip on the second component; and pulling the support assembly free from the overhead ceiling support rail. The channel on the lift pole is correspondingly shaped to an engagement lip in the lower swivel housing to facilitate alignment therebetween. The first component comprises an upper wing which is attachable to the overhead rail by a magnet arrangement therebetween. The second component comprises a lower wing which is rotatable with respect to the upper wing by a slidable shoulder engagement arranged therebetween. The upper swivel housing has a swivel cap thereon in fixed attachment with the lower swivel housing to permit support of the lower swivel housing to the upper swivel housing.

The invention also includes a method of removing a sign support assembly from an overhead support rail, comprising: inserting a pointed tip on a distalmost engagement end of a lift pole into a tapered alignment port in the sign support assembly; mating a channel on a side of the engagement end of the lift pole with a correspondingly shaped lip adjacently within the alignment port of the sign support assembly; and pulling downwardly on the lift pole to disengage the assembly from magnetic attachment to the overhead rail.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 1:
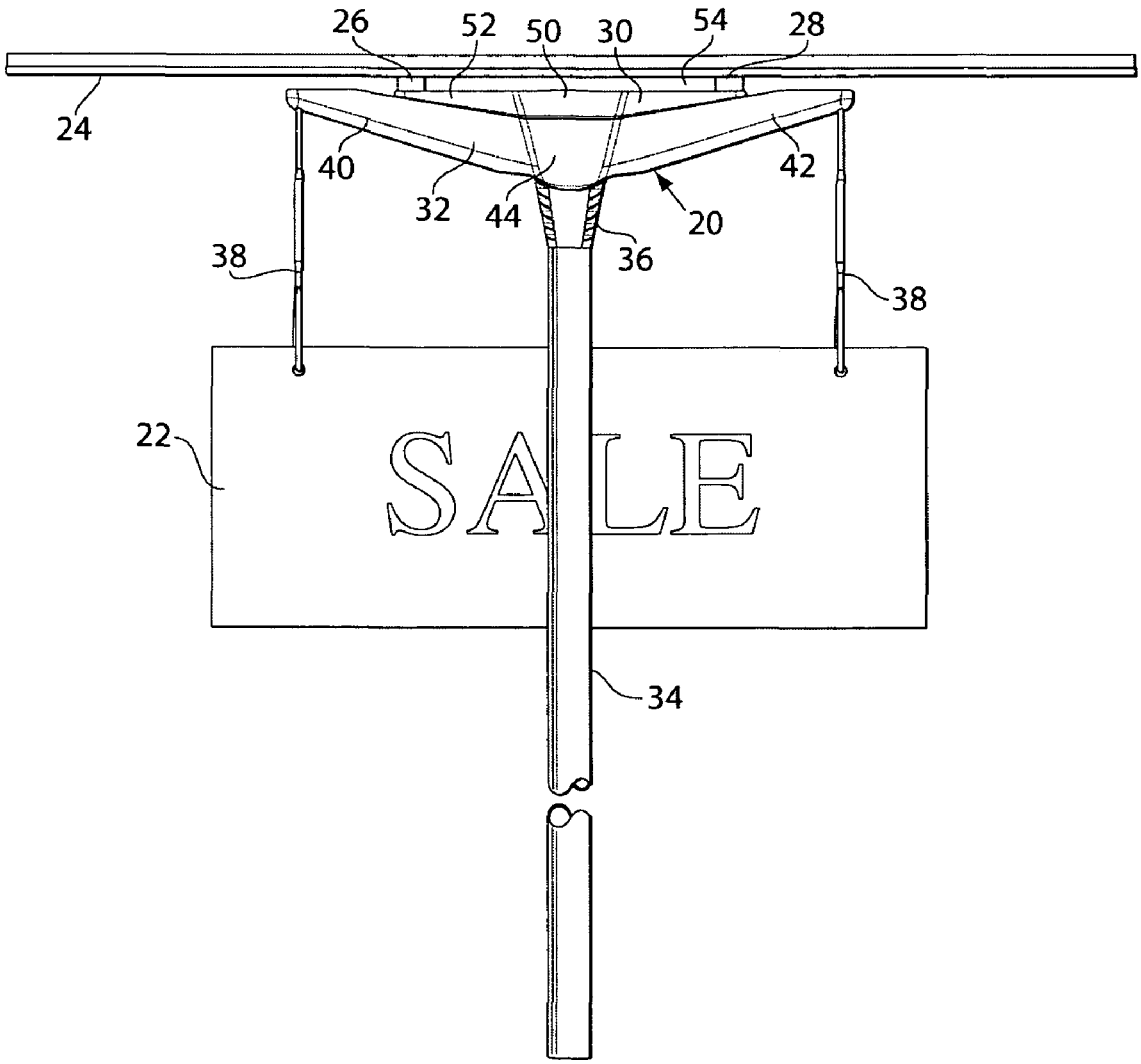
FIG. 1 is a side elevational view of a multi-component swivel assembly being attached to an inverted ceiling rail by a lift pole thereinserted.
Figure 2:
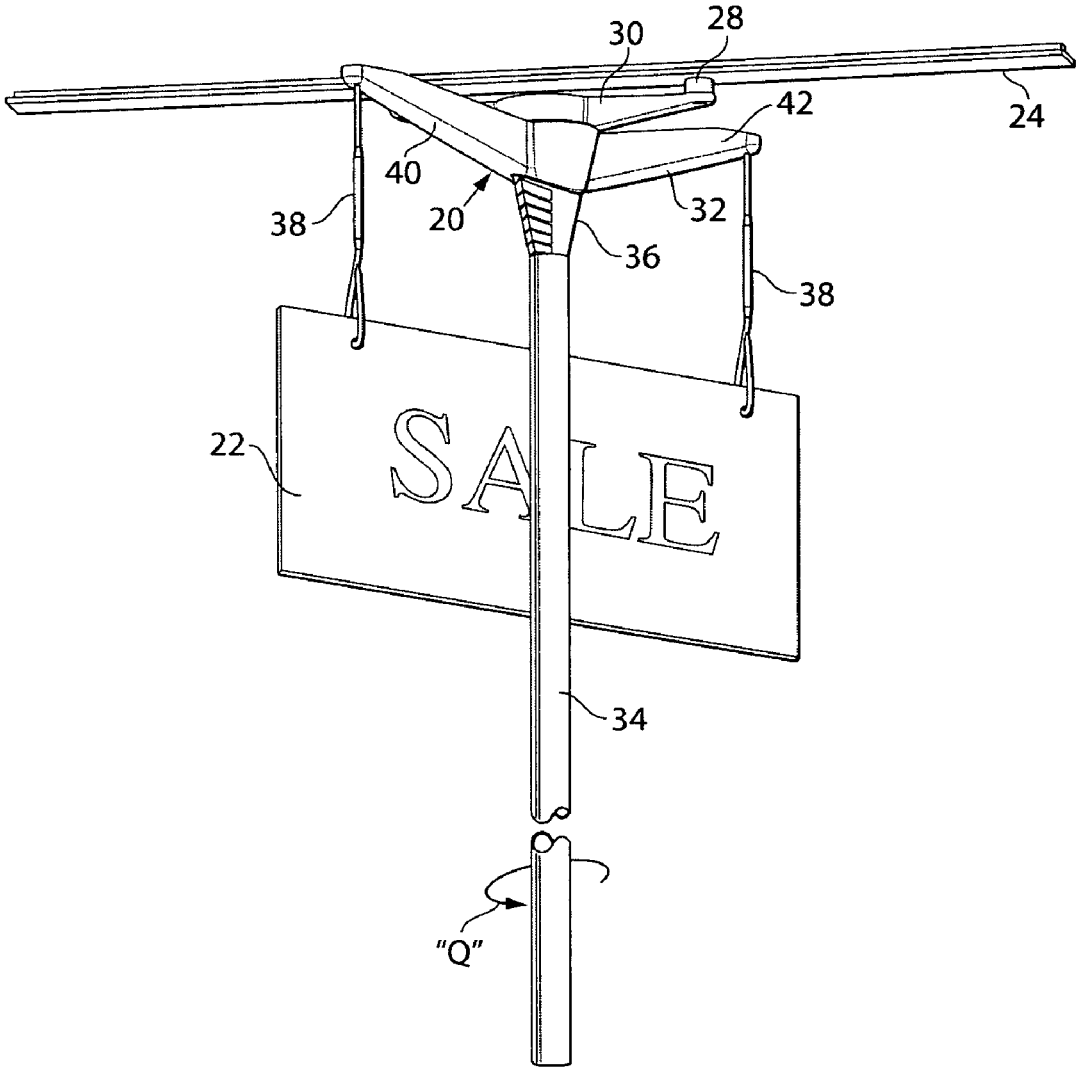
FIG. 2 is a view similar to FIG. 1, showing an elongated lift pole and a multi-component swivel assembly in a non alignment orientation with respect to an overhead t-rail.
Figure 3:
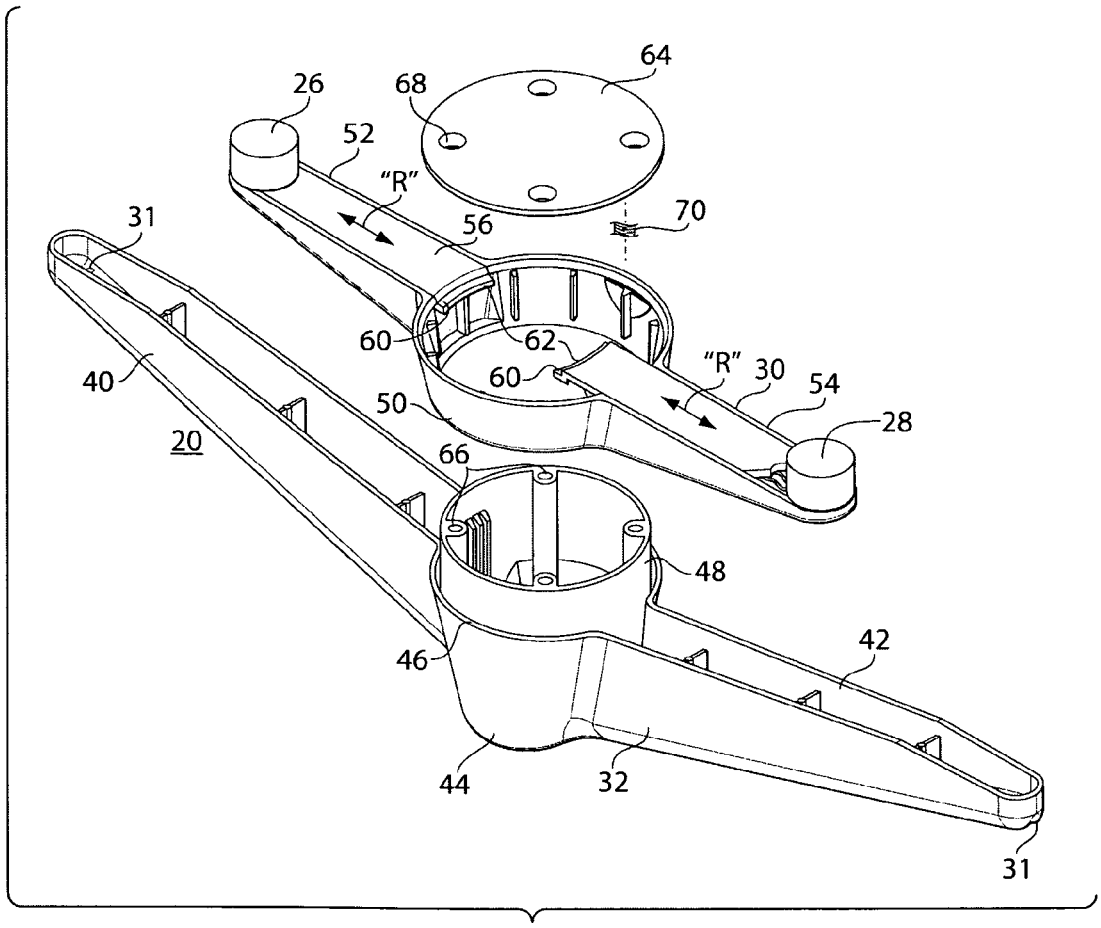
FIG. 3 is an exploded view of a multi-component swivel assembly shown in FIG. 1.
Figure 4:
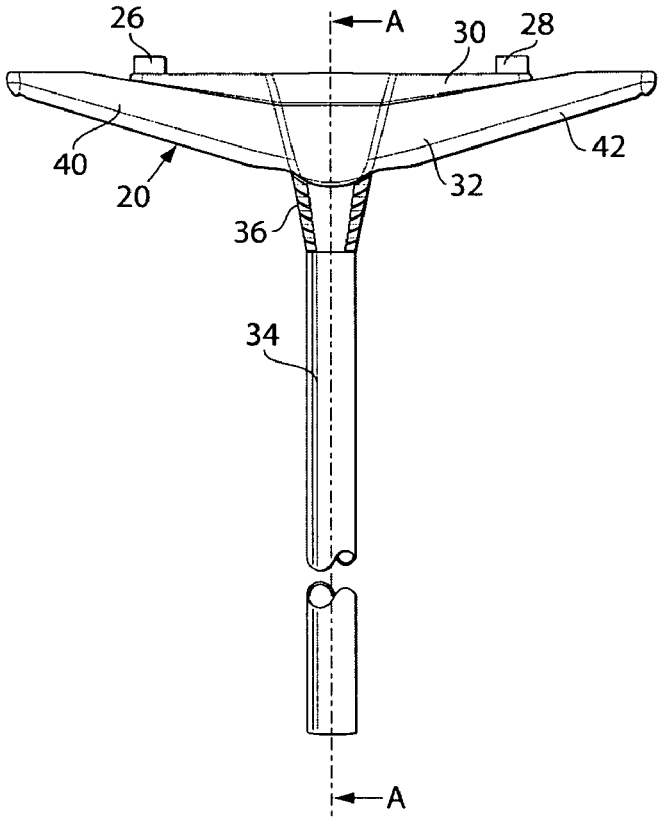
FIG. 4 is a side elevational view of a lifting pole and multi-component swivel assembly in an upward installation configuration.
Figure 9:
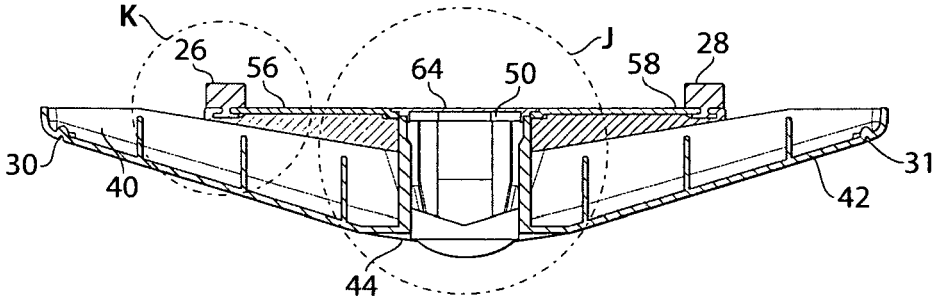
FIG. 9 is a sectional view taken along the lines E-E of FIG. 8.

Referring now to the drawing in detail, and particularly to FIG. 1, there is shown the present invention which comprises a multi-component swivel assembly 20 for attaching an advertisement or sign 22 in a manipulable manner to an overhead inverted "T"-shaped ceiling rail 24. The swivel assembly 20 is attached to the overhead ceiling rail 24 by a set of spaced apart magnets 26 and 28 which are disposed on the upwardly directed side of an upper molded swivel wing 30 which is a component of the multi-component swivel assembly 20. The advertising sign 22 is supported from a molded lower swivel wing 32 which is in swiveling engagement with the upper swivel wing 30 thereattached. The multi-component swivel assembly 20 is raised to the inverted "T"-shaped ceiling rail 24 by an elongated lift pole 34 having a distal lift pole "engagement end" 36. The lower swivel wing 32, has a set of support lines 38 each of which extend from a multi-hanger receipt-capable opening 31 arranged through an end of each lower swivel wing 32, as represented in FIGS. 3 and 9, and attached to the advertisement sign 22 therebeneath, as shown in FIGS. 1 and 2. The multi-component swivel assembly 20 comprises the lower swivel wing 32 having an elongated first lower arm 40 and a second lower arm 42 extending diametrically opposed one another from opposite sides of a generally cylindrically shaped lower swivel housing 44, best represented in FIG. 3.

Figure 10:
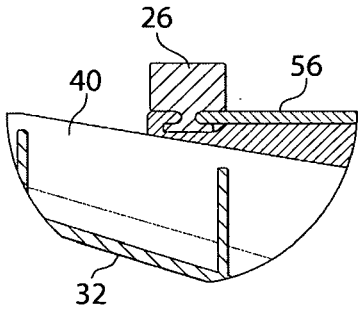
FIG. 10 is an enlarged sectional view of the detail K shown in FIG. 9.
Figure 11:
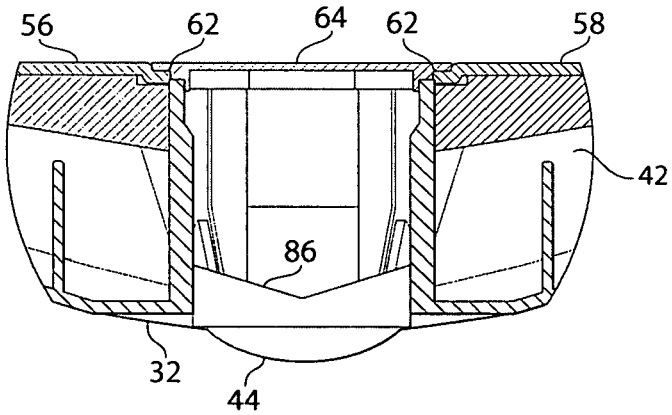
FIG. 11 is an enlarged sectional view of the detail "J" shown in FIG. 9.

The lower swivel housing 44 has a shouldered annular support surface 46 extending generally circumferentially therearound, as shown in FIG. 3. An inner annular flange 48 extends upwardly from the shouldered angular support surface 46 and is arranged to receive an annular upper swivel housing 50 of the upper swivel wing 30, as represented in FIGS. 3, 9 and 11. The upper swivel wing 30 comprises a first upper arm 52 and a second upper arm 54 diametrically opposed about the upper swivel housing 50, as shown in FIGS. 1, 3, 9 and 11. The magnets are lockably disposed at each distalmost end of each of the upper first and the second arms 52 and 54 of the upper swivel housing 50, as shown in FIGS. 3, 9 and 10. The upper first arm 52 and the upper second arm 54 each have the magnet extending upwardly from their distalmost ends, as best represented in FIG. 3. The upper first arm 52 and the upper second arm 54 each have an elongated magnet locking plate 56 and 58, respectively, slidably disposed therein, as represented by arrow "R" in FIG. 3, and also in FIGS. 9 and 10. Each elongated magnet locking plate 56 and 58 is radially displaceable so as to permit locking attachment of a magnet 26 and/or 28 at the distalmost ends of the respective arms 40 and 42. Each elongated magnet locking plate 56 and 58 has a radially inwardly directed or proximal end with a stepped cap-engaging lip 60 arranged thereon, as may be seen in FIG. 3. Each stepped cap-engaging lip 60 has an arcuate innermost edge 62. The upper swivel housing 50 and its respective first and second upper arms 52 and 54 are arranged to rotatively mate on the annular shouldered support surface 46 of the lower swivel housing 44.

A circular, planar swivel cap 64 is attachable to the upper side of the upper swivel housing 50 and has a peripheral edge which is in slidable engagement with the arcuate inner surfaces 62 of the stepped capped engaging lip 60 on each respective elongated magnet locking plate 56 and 58, as represented in FIGS. 3 and 11. The swivel cap 64 is secured to an arrangement of threaded connector receiving openings 66 molded within the inside contours and parallel to the longitudinal axis "L" of the rotatable lower swivel housing 44, as represented in FIG. 3. The swivel cap 64 has a plurality of openings 68 for receipt of the upper end of the threaded connectors 70 to be disposed between the swivel cap 64 and the lower wing swivel housing 44, as is also shown in FIG. 3. The threaded connection of the swivel cap 64 to the lower swivel housing 44 with the upper swivel housing 50 sandwiched therebetween holds the assembly 20 together.

The upper swivel wing 30 is arranged so as to permit rotation between the upper swivel wing 30 and the lower swivel wing 32 once the magnets 26 and 28 are attached to the lower side of an inverted "T"-shaped ceiling rail 24, as represented in FIGS. 1 and 2.

Figure 5:
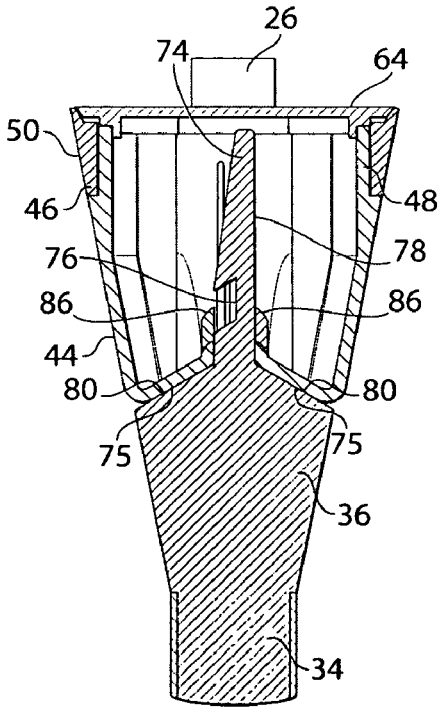
FIG. 5 is a sectional view taken along the lines A-A of FIG. 4.
Figure 6:
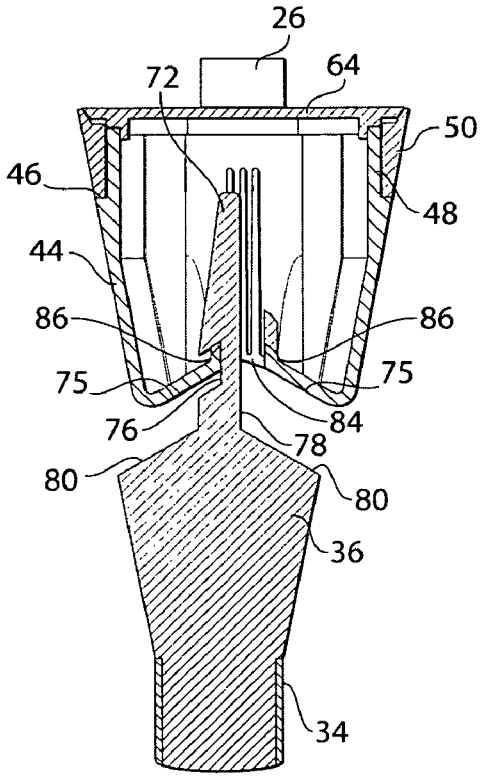
FIG. 6 is a view similar to FIG. 5, showing the lift pole and a portion of the multi-component swivel assembly in a swivel assembly removal configuration from an overhead support.
Figure 7:
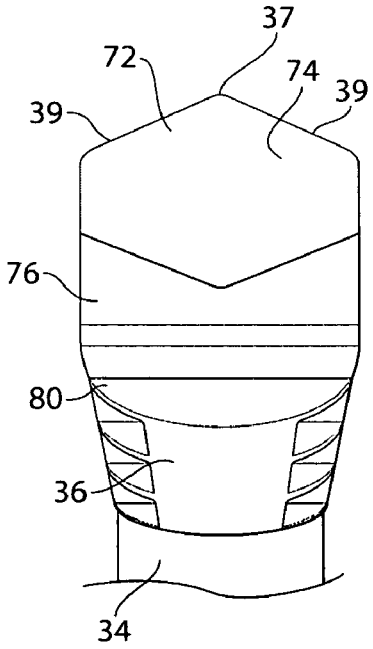
FIG. 7 is a front elevational view of the lift pole engagement end showing a front face thereof and its engagement flange locking channel thereon.
Figure 8:
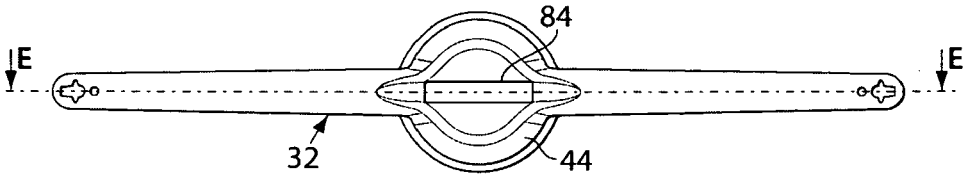
FIG. 8 is a bottom view of the lower swivel housing and its respective first and second lower arms thereof.

The multi-component swivel assembly 20 is liftable towards and removable from the ceiling rail 24 by a lift pole 34, as aforementioned. The lift pole 34 engagement end 36 has a pointed tip or distalmost end 37, with sloped or tapered shouldered shoulders 39 thereon, shown best in FIG. 7, and also having a body portion which is also shown in FIGS. 1, 5, 6 and 7. The lift pole engagement end 36 is comprised of a generally flat, distal, lower wing engagement flange 72, as shown in a sectional view in FIG. 5. The distal engagement flange 72 has a front face 74 with a generally self-aligning, chevron shaped engagement-flange locking-channel 76 recessed thereacross, as represented in a sectional view in FIGS. 5 and 6, and in an elevational or "face" view in FIG. 7. The distal, lower wing engagement flange 72 has a generally planar or flat rear face 78 thereon, as may be seen in FIGS. 5 and 6. The front face 74 and the rear face 78 of the engagement end 36 of the lift pole 34 proximately have a pair of sloped pole shoulders 80 arranged thereon, as best represented in FIG. 6. The lower swivel housing 44 has a pair of matching or corresponding sloped lower housing shoulders 82 which correspond in slope, to the pair of pole shoulders 80 proximally adjacent the engagement flange 72, again best represented in FIG. 6. The sloped shoulders 39 on the engagement end 36 of the pole 34 comprise an "alignment port" to permit a self-alignment and entry of the distalmost end 37 of the pointed engagement end of the lift pole 34 into an elongated flange receiving slot 84 extending diametrically across the lower swivel housing 44 which is arranged diametrically thereacross, as represented in FIGS. 5, 6 and 8, arranged so as to receive the distalmost engagement flange 72 of the lift pole 34, as represented in FIGS. 5 and 6. A pair of corresponding chevron-shaped inwardly directed, engagement flange housing-receiving lips 86 are arranged on each side of the elongated flange receiving slot, 84, as represented in FIGS. 5, 6 and 11, shaped as a chevron to facilitate the self-aligning feature relationship between the pole 34 and the lower housing 44.

When it is desired to attach the magnets 26 and 28 which are arranged on the upper side of the upper swivel wing 30 to an overhead ceiling rail 24, and after the distalmost tip end 37 of the engagement end 36 is self-aligned through the lower housing's 44 angled shoulders 75 adjacent the receiving slot 84, the distal engagement flange 72 of the lift pole 34 is inserted through that elongated flange receiving slot 84 in the housing 44 of the lower wing 32, and the magnets 26 and 28 are directed and lifted towards magnetic attachment with the inverted "T"-shaped ceiling rail 24, as represented in FIGS. 1 and 2. That same lift pole 34, with its transverse distal engagement flange 72 thereon, may be utilized to swivel the lower swivel wing 32 with respect to the upper swivel wing 30 by torqued rotation "Q" of the lift pole 34, as represented in FIG. 2. The support lines 38 would be extending from each end of the lower swivel wing 32, to corresponding respective ends of a sign 22 to be supported therefrom, as represented in FIGS. 1 and 2

When it is desired to remove a sign and change it from attachment with an overhead rail 24, the lift pole 34 is then self-alignably re-inserted into the tapered area of the lower swivel housing 44 and its distal engagement flange 72 is then re-inserted into the elongated-flange receiving slot 84, and brought down slightly, as represented in FIG. 6, so that the engagement flange locking channel 76, of chevron shape, mates with one or the other of the engagement flange housing receiving lips 86 on one of the sides of the elongated receiving slot 84 in the housing 44 in the lower wing 32, as represented in a sectional view in FIG. 6. A mere pulling downardly of the elongated lift pole 34 will break the magnetic attachment between the magnets 26 and 28 and the overhead ceiling rail 24, to permit the entire multi-component swivel assembly 20 to be removed therefrom and a new sign or advertisement 22 thereattached or for subsequent reattachment to that ceiling rail 24.

We claim:

1. A swivelable support assembly for angularly adjustably supporting a sign from an overhead support rail, the swivelable assembly comprising:

an elongated upper wing attachable to said overhead rail;

an elongated lower wing swivelably attached to said upper wing by a swivelable connection therebetween, said sign securable to said lower wing, said lower wing having an alignment port for facilitated receipt of a lift pole therein, wherein said upper wing comprises a first upper arm and a second upper arm arranged diametrically about an upper swivel housing.

2. The support assembly as recited in claim 1, wherein said lower wing comprises a first lower arm and a second lower arm arranged diametrically about a lower swivel housing.

3. The support assembly as recited in claim 2, wherein said lower housing is rotatable with respect to said upper housing.

4. The support assembly as recited in claim 2, wherein said lower swivel housing has a receiving opening for receipt of a lift pole.

5. The support assembly as recited in claim 2, wherein said lower swivel housing is rotatable about its longitudinal axis by rotation of a lift pole installed therewith, with respect to said upper swivel housing.

6. The support assembly as recited in claim 1, wherein said first upper arm and said second upper arm has a magnet secured to a distal end thereof.

7. The support assembly as recited in claim 6, wherein said magnet is lockable in place by a slidable elongated plate movable to and from said distal end of said first upper arm and said second upper arm.

8. The support assembly as recited in claim 1, wherein said sign is securable to said lower wing by a support line extending from an end of said wing.

9. A method of angularly adjustably supporting a sign from an overhead ceiling support rail comprising:

lifting a multi-component support swivel assembly into attachment with said overhead ceiling support rail by a self-alignably engagable lift pole inserted into an alignment port arranged into a lower housing thereof, said support swivel assembly having a sign attached thereto;

rotating a second component of support swivel assembly with respect to a first component of said support swivel assembly, by rotation of said lift pole inserted into said alignment port in lower housing, to permit said sign to line up with any desired horizontally angular orientation;

inserting said self-alignably engaging lift pole into said alignment port of said second component of said multi-component support swivel assembly;

engaging a channel on said lift pole into fitting engagement with a correspondingly shaped lip within said second component; and pulling said support assembly free from said overhead ceiling support rail.

10. The method as recited in claim 9, wherein said channel on said lift pole is correspondingly shaped to an engagement lip in said lower swivel housing to facilitate alignment therebetween.

11. The method as recited in claim 9, wherein said first component comprises an upper wing which is attachable to said overhead rail by a magnet arrangement therebetween.

12. The method as recited in claim 9, wherein said second component comprises a lower wing which is rotatable with respect to said upper wing by a slidable shoulder engagement arranged therebetween.

13. The method as recited in claim 9, wherein said upper swivel housing has a swivel cap thereon in fixed attachment with said lower swivel housing to permit support of said lower swivel housing to said upper swivel housing.

14. A method of removing a sign support assembly from an overhead support rail in a ceiling, comprising:

inserting a pointed tip on a distalmost engagement end of a lift pole into a taperingly shaped alignment port in said sign support assembly;

mating a channel on a side of said engagement end of said lift pole with a correspondingly shaped lip adjacently within said alignment port of said sign support assembly;

pulling downwardly on said lift pole to disengage said assembly from said overhead rail.

* * * * *